US008746120B1

(12) United States Patent
Nolting et al.

(10) Patent No.: US 8,746,120 B1
(45) Date of Patent: Jun. 10, 2014

(54) BOOSTED ELECTROMAGNETIC DEVICE AND METHOD TO ACCELERATE SOLID METAL SLUGS TO HIGH SPEEDS

(71) Applicants: Eugene Ellis Nolting, Columbia, MD (US); William Bryan Maier, II, Marina, CA (US); Gene Morris, Seaside, CA (US)

(72) Inventors: Eugene Ellis Nolting, Columbia, MD (US); William Bryan Maier, II, Marina, CA (US); Gene Morris, Seaside, CA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 70 days.

(21) Appl. No.: 13/656,464

(22) Filed: Oct. 19, 2012

Related U.S. Application Data

(60) Provisional application No. 61/554,370, filed on Nov. 1, 2011.

(51) Int. Cl.
*F41B 6/00* (2006.01)
*F41A 19/58* (2006.01)
*F42C 19/12* (2006.01)

(52) U.S. Cl.
USPC ..... 89/8; 89/28.05; 102/202

(58) Field of Classification Search
CPC ..... F41B 6/00; F42C 19/12
USPC ..... 89/8, 28.05, 28.1; 102/202, 202.5, 102/202.7, 202.8, 202.9, 202.11, 472; 124/3
See application file for complete search history.

(56) References Cited

U.S. PATENT DOCUMENTS

| | | | | |
|---|---|---|---|---|
| 667,435 | A | 2/1901 | Friese-Greene et al. | |
| 4,534,263 | A * | 8/1985 | Heyne et al. | 89/8 |
| 4,715,261 | A | 12/1987 | Goldstein et al. | |
| 4,913,029 | A | 4/1990 | Tidman et al. | |
| 4,967,637 | A * | 11/1990 | Loffler et al. | 89/1.816 |

(Continued)

OTHER PUBLICATIONS

Sivkov, A.A., "Hybrid Electromagnetic System for Acceleration of Solids." Journal of Applied Mechanics and Technical Physics, vol. 42, pp. 1-9, 2001.

*Primary Examiner* — Bret Hayes
(74) *Attorney, Agent, or Firm* — Naval Postgraduate School; Lisa A. Norris

(57) ABSTRACT

A device and method which combine electromagnetic acceleration with acceleration by high-pressure gases derived from chemical energy to achieve high slug speeds. In one embodiment the device includes a cylindrical metal tube having an outer diameter and an inner diameter and a central channel; at least one conductive coil surrounding the metal tube; a metal slug disposed within the central channel; a conducting central electrode, having a centrally formed cavity; a conducting rod having at least one cavity including a propellant, wherein a first portion of the conducting rod is attached to the metal slug at a connection point, a second portion of the conducting rod extends between the metal slug and the central electrode, and a third portion of the conducting rod extends within the cavity of the central electrode such that a space is formed between the end of the third portion and the back of the cavity within the central electrode; and an insulator disposed within the central channel and surrounding the conducting central electrode and the second portion of the conducting rod except at the connection point. When a current is applied to the metal tube, the central electrode, and the at least one conductive coil causes the conducting rod to break with resultant generation of a plasma which ignites the propellant such that the energy from the propellant and electromagnetic forces accelerate the slug to speeds greater than are achievable by the propellant alone.

2 Claims, 2 Drawing Sheets

(56) References Cited

U.S. PATENT DOCUMENTS

| | | | | | |
|---|---|---|---|---|---|
| 5,005,484 | A | | 4/1991 | Witt | |
| 5,042,359 | A | | 8/1991 | Witt et al. | |
| 5,094,141 | A | | 3/1992 | Zwingel et al. | |
| 5,115,743 | A | * | 5/1992 | Loffler | 102/472 |
| 5,171,932 | A | * | 12/1992 | McElroy | 89/8 |
| 5,331,879 | A | | 7/1994 | Loffler | |
| 5,503,058 | A | * | 4/1996 | Marinos | 89/8 |
| 5,503,081 | A | * | 4/1996 | Lindblom et al. | 102/472 |
| 5,546,844 | A | * | 8/1996 | Krumm et al. | 89/8 |
| 5,612,506 | A | | 3/1997 | Goldstein | |
| 5,688,416 | A | * | 11/1997 | Johnson | 219/121.48 |
| 5,854,439 | A | * | 12/1998 | Almstrom et al. | 89/8 |
| 6,119,599 | A | * | 9/2000 | Johnson et al. | 102/472 |

* cited by examiner

BOOSTED ELECTROMAGNETIC DEVICE AND METHOD TO ACCELERATE SOLID METAL SLUGS TO HIGH SPEEDS

CROSS-REFERENCE TO RELATED APPLICATIONS

This application claims the benefit of U.S. Provisional Application No. 61/554,370 filed Nov. 1, 2011, which is hereby incorporated in its entirety by reference.

BACKGROUND OF THE INVENTION

1. Field of the Invention

The present invention relates generally to electromagnetic and chemical acceleration of projectiles.

2. Description of the Related Art

High velocity metal slugs have a variety of uses, but rather large and complicated facilities, e.g. staged gas guns, are required to produce speeds of over about 1 km/s. Chemical propellants ignite and produce a high pressure gas that pushes metal slugs out of gun barrels. The speed that can be achieved is limited by the speed of sound in the combustion products, which may reach a few thousand degrees Kelvin (K). Speeds nearing 1.2 km/s have been achieved in some prior art systems but are not normally reached. Prior art railguns routinely accelerated projectiles to speeds greater than 1.2 km/s; however, railgun barrel construction is complicated and expensive, and the barrel lifetime is limited. In prior art railgun systems, immense forces push the rails apart, and very strong containment is required; insulators are utilized to separate the conducting rails, and large power supplies are required.

Prior art purely electromagnetic launchers required a large amount of electrical energy to drive the projectiles, and the large amount of electrical energy must be stored at high voltage. Electrical storage combining high energy density, high power density, and high voltage is bulky and heavy. Batteries and electrical double layer capacitors have high energy density but low voltage and limited power density. Chemical energy storage has much higher density than electromagnetic storage but conversion from chemical to electromagnetic energy normally requires significant processing. Electrothermal chemical ((ETC) and electrochemical (EC) guns use chemical energy to accelerate a projectile, but fail to achieve really high slug speeds because they use electromagnetic energy to ignite the propellant but not to accelerate the slug after the chemical propellant has ignited.

SUMMARY OF THE INVENTION

Embodiments in accordance with the invention described herein combine electromagnetic acceleration with acceleration by high-pressure gases derived from chemical energy to achieve high slug speeds. In accordance with one embodiment, a boosted tubular electromagnetic launcher (BTEL) device includes: a cylindrical metal tube having an outer diameter and an inner diameter and a central channel; conductive coils surrounding at least a portion of the tube; a metal slug disposed within the central channel; a conducting central electrode, having a centrally formed cavity; a conducting rod having one or more propellant cavities, where a first portion of the conducting rod is attached to the metal slug at a connecting point, a second portion of the conducting rod extends between the metal slug and the central electrode, and a third portion of the conducting rod extends within the cavity of the central electrode such that a space is formed between the end of the third portion and the back of the cavity within the central electrode; and an insulator disposed within the central channel and surrounding the conducting central electrode and the second portion of the conducting rod except at the connecting point, wherein application of a current to the metal tube, coils, and the central electrode causes the conducting rod to break with resultant generation of a plasma, ignition of the propellant and acceleration of the metal slug to a high speed.

In another embodiment, a method for accelerating a solid metal slug to a high speed by the device is also described.

Embodiments in accordance with the invention are best understood by reference to the following detailed description when read in conjunction with the accompanying drawings.

Embodiments in accordance with the invention are further described herein with reference to the drawings.

DETAILED DESCRIPTION OF THE INVENTION

As further described herein, embodiments in accordance with the invention generate a very hot plasma arc formed on the central axis of a tube to ignite a propellant. The energy from the propellant boosts a metal slug to a moderately high speed (≈1000-1200 m/s) and the electromagnetic forces accelerate the slug to speeds greater than could be achieved by the propellant alone.

Figure 1:
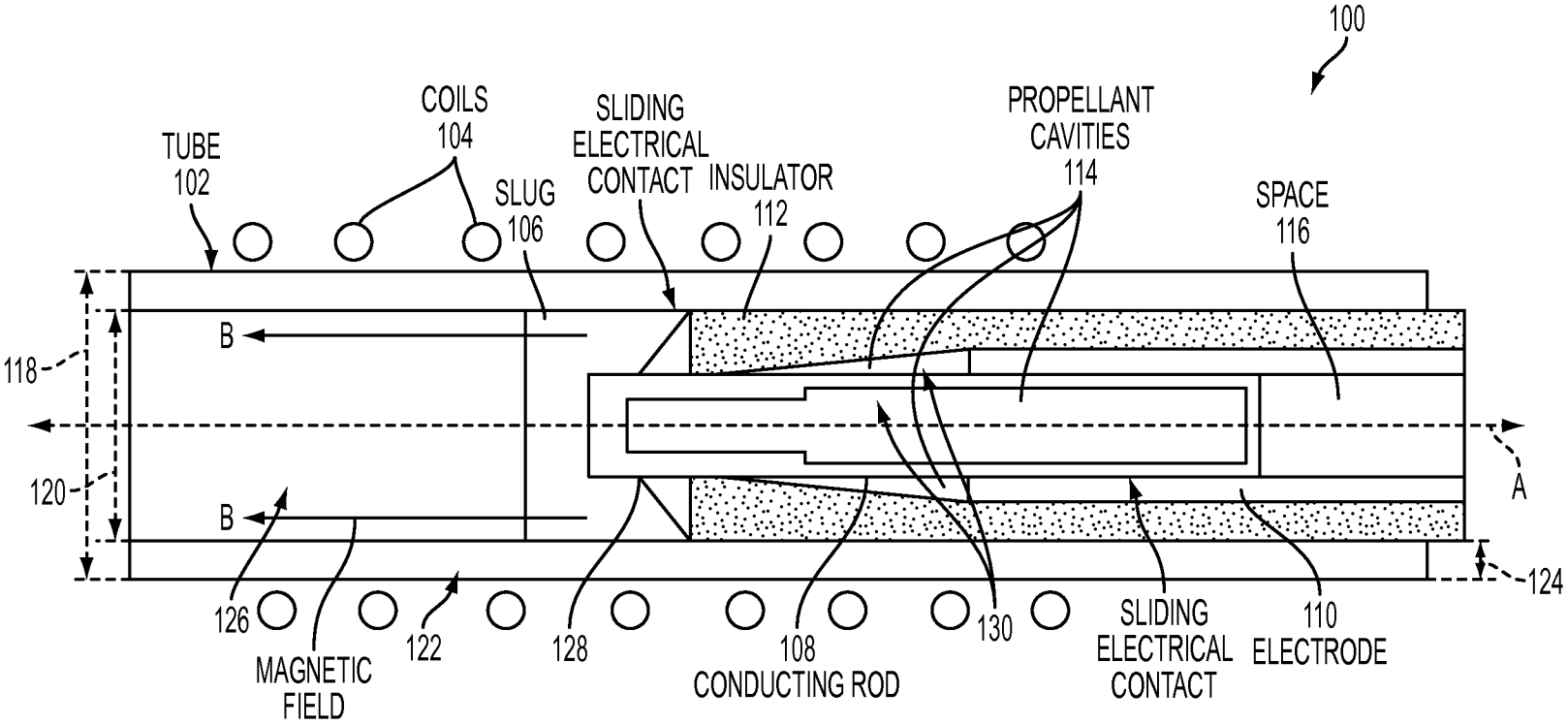
FIG. 1 illustrates a cross-sectional view of a schematic configuration of a boosted tubular electromagnetic launcher (BTEL) device 100 in accordance with one embodiment.

FIG. 1 illustrates a cross-sectional view of a schematic configuration of a boosted tubular electromagnetic launcher (BTEL) device 100 in accordance with one embodiment. As illustrated in FIG. 1, boosted tubular electromagnetic launcher 100 includes: a cylindrical metal tube 102; conductive coils 104 encircling at least a portion of tube 102; a projective, such as a metal slug 106; a conducting rod 108 having propellant cavities 114; a conducting central electrode 110; and an insulator 112. Not shown are current carrying attachments which couple tube 102, coils 104 and central electrode 110 to a power supply capable of supplying current to device 100. The power supply is connected to the current carrying attachments and when initiated, provides power to device 100 via the current carry attachments. The electrical current flowing in coils 104 imposes a longitudinal magnetic field ("B") in tube 102.

Tube 102 has an exterior diameter 118 and interior diameter 120 resulting in tube wall 122 with a wall thickness 124 and an interior channel 126 of diameter 120 having a central axis shown as A. In one embodiment tube 102 is formed a strong material, such as one or more metals, that permits the imposed longitudinal magnetic field to diffuse through tube wall 122 into the interior of tube 102, e.g., into interior channel 126, in a short enough time to be present when the current breaks conducting rod 108. The material selected should be strong enough to withstand large pressures produced within channel 126.

Disposed within interior channel 126 is slug 106 which is attached to conducting rod 108 at a connecting point 128. In one embodiment, conducting rod 108 is formed of a conductive rod material and is formed with propellant cavities 114 for receiving a propellant. In FIG. 1 propellant cavities 114 are illustrated filled with a propellant 130. In other embodiments, propellant cavities 114 can be differently shaped and differently located in conducting rod 108. Many possible propellants can be used in device 100, for example, $Al/H_2O$ mixtures, solid Teflon/Al, or other thermites. In still other embodiments, liquid water can be placed in some of propellant cavities 114 enabling a generated plasma arc to vaporize both Al and water, which may then react.

In one embodiment a first portion of conducting rod 108 is seated in slug 106 and the remainder of conducting rod 108 extends from slug 106 through insulator 112 and partially into central electrode 110; in this configuration a central second portion of conducting rod 108 is surrounded by insulator 112 and a third portion of conducting rod 108 extends into central electrode 110. Central electrode 110 is formed of a conductive electrode material and has a central cavity formed though a portion of the conductive electrode material. The third portion of conducting rod 108 partially extends into the central cavity of central electrode 110 resulting in a space 116 between the end of the third portion of conducting rod 108 and the end of central electrode 110. In this configuration conducting rod 108 provides an electrically conductive connection between slug 106 and central electrode 110. In one embodiment, insulator 112 electrically isolates central electrode 110 from tube wall 122, except at the connection of conducting rod 108 to slug 106 at connection point 128.

Figure 2:
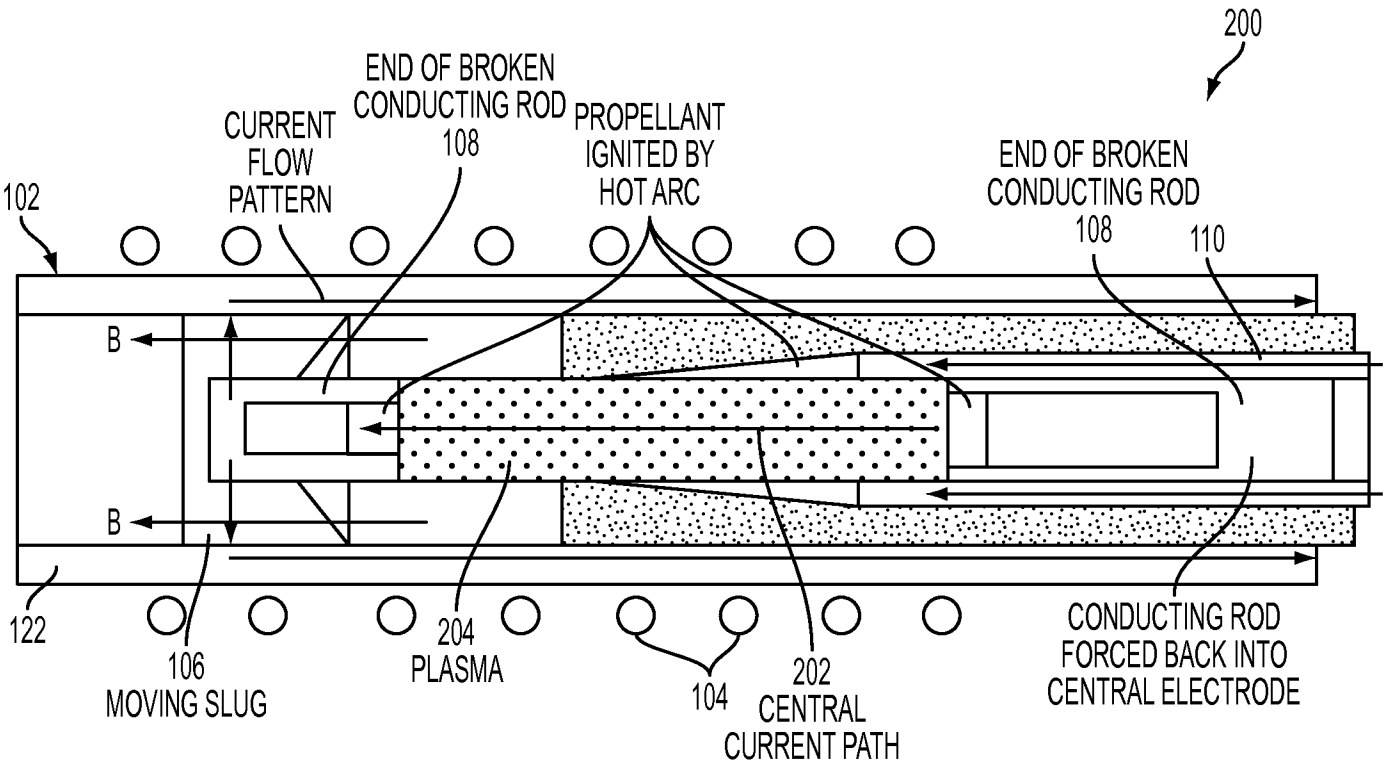
FIG. 2 illustrates a schematic depiction of current flow in the boosted tubular electromagnetic launcher (BTEL) device of FIG. 1 when the plasma is fully developed in accordance with one embodiment.

FIG. 2 illustrates a schematic depiction 200 of a current flow 202 in the boosted tubular electromagnetic launcher (BTEL) device 100 of FIG. 1 when a plasma 204 is fully developed in accordance with one embodiment. For clarity of description identifiers utilized in FIG. 1 are referred to and identified in FIG. 2. In FIG. 2, on initiation, a high current is passed from a power supply (not shown) through central electrode 110 and conducting rod 108 to slug 106, and back down tube wall 122. Electromagnetic forces accelerate slug 106 and mechanically break conducting rod 108. An extremely hot electrical plasma 204, also termed a plasma arc, is formed on the centerline of tube 102, and plasma 204 ignites propellant 130 and causes propellant 130 to burn.

The current in plasma 204 is guided and centralized by the axial magnetic field from the current (not shown) flowing in device 100 and by the longitudinal magnetic field ("B") imposed in tube 102 by the current through coils 104. Burning propellant 130 raises the pressure in tube 102 behind slug 106 and accelerates slug 106. After a time, the speed of slug 106 will outrun the expanding gas from propellant 130 and the acceleration will then be primarily electromagnetic again. Plasma 204 must maintain stability as it passes through the products of combustion of burning propellant 130 for effective acceleration. In testing plasma 204 maintains its stability through a gas having pressure equal to 1500-2000 atm but data specific to the combustion products was determined. Preliminary tests indicate 40% and 65% of the slug's energy was derived from the propellant at slug speeds of ≈1000 m/s when liquid water was introduced into a propellant cavity in conducting rod 108.

The electromagnetic energy plays several roles in launching the slug, e.g., slug 106. In a first phase, the electromagnetic energy initially serves as the prime mover and during this time energy is inductively stored in the circuit of device 100. Next, the electrical circuit forms the plasma arc, e.g., plasma 204, along the tube axis, A which because of the geometry rapidly heats the chemical reactants, e.g., propellant 130. During this second phase, the electromagnetic energy and hot chemical product gases both act on the slug, e.g., slug 106, to propel it down the tube, e.g., tube 102. At this phase, most of the slug's acceleration is due to the hot gases. In the final phase, the ability of the hot gases to continue to accelerate the slug diminishes and the dynamics become dominated by the electromagnetic Lorentz forces.

In one embodiment, and in no way a limiting on the invention, the exothermic chemical reaction represented by the equation given below has the virtues of low cost, being benign at room temperature, and capable of releasing approximately 0.8 MJ.

| Reactants | | Products |
|---|---|---|
| 3H2O + 2 Al | -> | 3H2 + Al2O3 |
| 3(−285.8 kJ/mol) | | (−1669.8 kJ/mol) |
| Heats of Fusion | | −812.4 kJ/mol |

Furthermore, measured energy densities of 6.4 kJ/gm (~7.3 kJ/cc) are realizable. It is the high energy densities that allow a compact design.

Typically a plasma arc heated by a several hundred kiloamp current should be at temperatures of about 3 eV (~35,000K), which is adequate to create a detonation wave in the propellant. To maximize the exothermic reaction, the aluminum is used in finely divided powder form and becomes a paste when mixed with the water. Oxidizers other than water can be used. The powder improves the speed and efficiency of the chemical reaction. Measured chemical conversion has been reported as high as 85%.

As described above, embodiments in accordance with the invention described herein combine electromagnetic acceleration with acceleration by high-pressure gases derived from chemical energy to achieve high slug speeds. In one embodiment, a boosted tubular electromagnetic launcher (BTEL) device is configured as a small, electromagnetically actuated device that can accelerate metal slugs to speeds above 1.2 km/s.

Embodiments in accordance with the invention can be configured with differently shaped conducting rods, propellant cavities, and slugs and have applicability to wide range of applications that accelerate conductive projectiles, for example to accelerate projectiles in cartridges and supersonic nozzles.

This disclosure provides exemplary embodiments of the present invention. The scope of the present invention is not limited by these exemplary embodiments. Numerous variations, whether explicitly provided for by the specification or implied by the specification or not, may be implemented by one of skill in the art in view of this disclosure.

What is claimed is:

1. A device for accelerating a metal slug comprising:

a cylindrical metal tube having an outer diameter and an inner diameter and a central channel;

at least one conductive coil surrounding said metal tube;

a metal slug disposed within said central channel;

a conducting central electrode, having a centrally formed cavity;

a conducting rod having at least one cavity including a propellant, wherein:

a first portion of said conducting rod is attached to said metal slug at a connection point, a second portion of said conducting rod extends between said metal slug and said central electrode, and a third portion of said conducting rod extends within said cavity of said central electrode such that a space is formed between the end of said third portion and the back of said cavity within said central electrode; and an insulator disposed within said central channel and surrounding said conducting central electrode and said second portion of said conducting rod except at said connection point, wherein application of a current to said metal tube, said central electrode, and at least one conductive coil causes said conducting rod to break with resultant generation of a plasma which ignites said propellant, such that the energy from said propellant and electromagnetic forces accelerate said slug to speeds greater than are achievable by said propellant alone.

2. A method for accelerating a metal slug in a device having:

a cylindrical metal tube having an outer diameter and an inner diameter and a central channel;

at least one conductive coil surrounding said metal tube;

a metal slug disposed within said central channel;

a conducting central electrode, having a centrally formed cavity;

a conducting rod having at least one cavity including a propellant, wherein:

a first portion of said conducting rod is attached to said metal slug at a connection point, a second portion of said conducting rod extends between said metal slug and said central electrode, and a third portion of said conducting rod extends within said cavity of said central electrode such that a space is formed between the end of said third portion and the back of said cavity within said central electrode; and an insulator disposed within said central channel and surrounding said conducting central electrode and said second portion of said conducting rod except at said connection point, said method comprising:

applying a current to said metal tube, said central electrode, and said at least one conductive coil which causes said conducting rod to break with resultant generation of a plasma which ignites said propellant, such that the energy from said propellant and electromagnetic forces accelerate said slug to speeds greater than are achievable by said propellant alone.

* * * * *